US007640987B2

(12) United States Patent
Kalman et al.

(10) Patent No.: US 7,640,987 B2
(45) Date of Patent: Jan. 5, 2010

(54) COMMUNICATING FLUIDS WITH A HEATED-FLUID GENERATION SYSTEM

(75) Inventors: Mark Kalman, Houston, TX (US); Wayne Ian Redecopp, Calgary (CA)

(73) Assignee: Halliburton Energy Services, Inc., Carrollton, TX (US)

( * ) Notice: Subject to any disclaimer, the term of this patent is extended or adjusted under 35 U.S.C. 154(b) by 357 days.

(21) Appl. No.: 11/205,871

(22) Filed: Aug. 17, 2005

(65) Prior Publication Data

US 2007/0039736 A1 Feb. 22, 2007

(51) Int. Cl.
*E21B 43/24* (2006.01)

(52) U.S. Cl. ..... 166/303; 166/59; 166/384

(58) Field of Classification Search ..... 166/59, 166/302, 303, 384; 175/12, 14
See application file for complete search history.

(56) References Cited

U.S. PATENT DOCUMENTS

| | | | | |
|---|---|---|---|---|
| 1,263,618 | A | | 4/1918 | Squires |
| 1,342,741 | A | | 6/1920 | Day |
| 1,457,479 | A | | 6/1923 | Wolcott |
| 1,726,041 | A | | 8/1929 | Powell |
| 1,918,076 | A | | 7/1933 | Woolson |
| 2,173,556 | A | | 9/1939 | Hixon |
| 2,584,606 | A | | 2/1952 | Merriam et al. |
| 2,670,802 | A | | 3/1954 | Ackley |
| 2,734,578 | A | | 2/1956 | Walter |
| 2,767,791 | A | | 10/1956 | van Dijck |
| 2,825,408 | A | | 3/1958 | Watson |
| 2,862,557 | A | | 12/1958 | van Utenhove et al. |
| 2,880,802 | A | | 4/1959 | Carpenter |
| 2,889,881 | A | | 6/1959 | Trantham et al. |
| 2,901,043 | A | | 8/1959 | Campion et al. |
| 2,914,309 | A | | 11/1959 | Salomonsson |
| 3,040,809 | A | | 6/1962 | Pelzer |
| 3,045,766 | A | * | 7/1962 | Fleming, Jr. ..... 175/14 |
| 3,055,427 | A | | 9/1962 | Pryor et al. |
| 3,113,619 | A | | 12/1963 | Reichle |
| 3,127,935 | A | | 4/1964 | Poettmann et al. |
| 3,129,757 | A | | 4/1964 | Sharp |
| 3,135,326 | A | | 6/1964 | Santee |
| 3,141,502 | A | | 7/1964 | Dew et al. |

(Continued)

FOREIGN PATENT DOCUMENTS

EP 0 088 376 A2 9/1983

(Continued)

OTHER PUBLICATIONS

K.C. Hong, "Recent Advances in Steamflood Technology," SPE 54078, Copyright 1999, Society of Petroleum Engineers, Inc., 14 pages.

(Continued)

*Primary Examiner*—Hoang Dang
(74) *Attorney, Agent, or Firm*—Fish & Richardson P.C.

(57) ABSTRACT

Some embodiments of a supply tube system for use in a wellbore may have multiple tubes, a number of which can be readily coupled to a downhole steam generator or other heated-fluid generator device. In certain embodiments, the system may include a connector that simplifies the process of coupling the supply tube system to the steam generator and provides for fluid communication between each supply conduit and the associated input port of the steam generator.

48 Claims, 4 Drawing Sheets

U.S. PATENT DOCUMENTS

| | | | | |
|---|---|---|---|---|
| 3,154,142 | A | | 10/1964 | Latta |
| 3,156,299 | A | | 11/1964 | Trantham |
| 3,163,215 | A | | 12/1964 | Stratton |
| 3,174,544 | A | | 3/1965 | Campion et al. |
| 3,182,722 | A | | 5/1965 | Reed |
| 3,205,944 | A | | 9/1965 | Walton |
| 3,221,809 | A | | 12/1965 | Walton |
| 3,232,345 | A | | 2/1966 | Trantham et al. |
| 3,237,689 | A | | 3/1966 | Justheim |
| 3,246,693 | A | | 4/1966 | Crider |
| 3,294,167 | A | | 12/1966 | Vogel |
| 3,310,109 | A | | 3/1967 | Marx et al. |
| 3,314,476 | A | | 4/1967 | Staples et al. |
| 3,315,745 | A | | 4/1967 | Rees, Jr. |
| 3,322,194 | A | | 5/1967 | Strubbar |
| 3,332,482 | A | | 7/1967 | Trantham |
| 3,334,687 | A | | 8/1967 | Parker |
| 3,342,257 | A | | 9/1967 | Jacobs et al. |
| 3,342,259 | A | | 9/1967 | Powell |
| 3,351,132 | A | | 11/1967 | Dougan et al. |
| 3,361,201 | A | | 1/1968 | Howard |
| 3,363,686 | A | | 1/1968 | Gilchrist |
| 3,363,687 | A | | 1/1968 | Dean |
| 3,379,246 | A | | 4/1968 | Sklar et al. |
| 3,379,248 | A | | 4/1968 | Strange |
| 3,406,755 | A | | 10/1968 | Sharp |
| 3,411,578 | A | | 11/1968 | Holmes |
| 3,412,793 | A | | 11/1968 | Needham |
| 3,412,794 | A | | 11/1968 | Craighead |
| 3,422,891 | A | | 1/1969 | Alexander et al. |
| 3,430,700 | A | | 3/1969 | Satter et al. |
| 3,441,083 | A | | 4/1969 | Fitzgerald |
| 3,454,958 | A | | 7/1969 | Parker |
| 3,456,721 | A | * | 7/1969 | Smith ..... 166/59 |
| 3,467,206 | A | * | 9/1969 | Acheson et al. ..... 175/13 |
| 3,490,529 | A | | 1/1970 | Parker |
| 3,490,531 | A | | 1/1970 | Dixon |
| 3,507,330 | A | | 4/1970 | Gill |
| 3,547,192 | A | | 12/1970 | Claridge et al. |
| 3,554,285 | A | | 1/1971 | Meldau |
| 3,605,888 | A | | 9/1971 | Crowson et al. |
| 3,608,638 | A | | 9/1971 | Terwilliger |
| 3,653,438 | A | | 4/1972 | Wagner |
| 3,685,581 | A | | 8/1972 | Hess et al. |
| 3,690,376 | A | | 9/1972 | Zwicky et al. |
| 3,703,927 | A | | 11/1972 | Harry |
| 3,724,043 | A | | 4/1973 | Eustance |
| 3,727,686 | A | | 4/1973 | Prates et al. |
| 3,759,328 | A | | 9/1973 | Ueber et al. |
| 3,771,598 | A | | 11/1973 | McBean |
| 3,782,465 | A | | 1/1974 | Bell et al. |
| 3,796,262 | A | | 3/1974 | Allen et al. |
| 3,804,169 | A | | 4/1974 | Closmann |
| 3,805,885 | A | | 4/1974 | Van Huisen |
| 3,822,747 | A | | 7/1974 | Maguire, Jr. |
| 3,827,495 | A | | 8/1974 | Reed |
| 3,837,402 | A | | 9/1974 | Stringer |
| 3,838,738 | A | | 10/1974 | Redford et al. |
| 3,847,224 | A | | 11/1974 | Allen et al. |
| 3,872,924 | A | | 3/1975 | Clampitt |
| 3,892,270 | A | | 7/1975 | Lindquist |
| 3,905,422 | A | | 9/1975 | Woodward |
| 3,929,190 | A | | 12/1975 | Chang et al. |
| 3,931,856 | A | | 1/1976 | Barnes |
| 3,945,679 | A | | 3/1976 | Closmann et al. |
| 3,946,809 | A | | 3/1976 | Hagedorn |
| 3,954,139 | A | | 5/1976 | Allen |
| 3,958,636 | A | | 5/1976 | Perkins |
| 3,964,546 | A | | 6/1976 | Allen |
| 3,967,853 | A | | 7/1976 | Closmann et al. |
| 3,978,920 | A | | 9/1976 | Bandyopadhyay et al. |
| 3,993,133 | A | | 11/1976 | Clampitt |
| 3,994,340 | A | | 11/1976 | Anderson et al. |
| 3,994,341 | A | | 11/1976 | Anderson et al. |
| 3,997,004 | A | | 12/1976 | Wu |
| 3,999,606 | A | | 12/1976 | Bandyopadhyay et al. |
| 4,004,636 | A | | 1/1977 | Brown et al. |
| 4,007,785 | A | | 2/1977 | Allen et al. |
| 4,007,791 | A | | 2/1977 | Johnson |
| 4,008,765 | A | | 2/1977 | Anderson et al. |
| 4,019,575 | A | | 4/1977 | Pisio et al. |
| 4,019,578 | A | | 4/1977 | Terry et al. |
| 4,020,901 | A | | 5/1977 | Pisio et al. |
| 4,022,275 | A | | 5/1977 | Brandon |
| 4,022,280 | A | | 5/1977 | Stoddard et al. |
| 4,026,358 | A | | 5/1977 | Allen |
| 4,033,411 | A | | 7/1977 | Goins |
| 4,037,655 | A | | 7/1977 | Carpenter |
| 4,037,658 | A | | 7/1977 | Anderson |
| 4,049,053 | A | | 9/1977 | Fisher et al. |
| 4,066,127 | A | | 1/1978 | Harnsberger |
| 4,067,391 | A | | 1/1978 | Dewell |
| 4,068,715 | A | | 1/1978 | Wu |
| 4,068,717 | A | | 1/1978 | Needham |
| 4,078,608 | A | | 3/1978 | Allen et al. |
| 4,084,637 | A | | 4/1978 | Todd |
| 4,085,799 | A | | 4/1978 | Bousaid et al. |
| 4,085,800 | A | | 4/1978 | Engle et al. |
| 4,088,188 | A | | 5/1978 | Widmyer |
| 4,099,564 | A | | 7/1978 | Hutchison |
| 4,114,687 | A | | 9/1978 | Payton |
| 4,114,691 | A | | 9/1978 | Payton |
| 4,120,357 | A | | 10/1978 | Anderson |
| 4,124,071 | A | | 11/1978 | Allen et al. |
| 4,129,183 | A | | 12/1978 | Kalfoglou |
| 4,129,308 | A | | 12/1978 | Hutchison |
| 4,130,163 | A | | 12/1978 | Bombardieri |
| 4,133,382 | A | | 1/1979 | Cram et al. |
| 4,133,384 | A | | 1/1979 | Allen et al. |
| 4,137,968 | A | * | 2/1979 | Howard et al. ..... 166/53 |
| 4,140,180 | A | | 2/1979 | Bridges et al. |
| 4,140,182 | A | | 2/1979 | Vriend |
| 4,141,415 | A | | 2/1979 | Wu et al. |
| 4,144,935 | A | | 3/1979 | Bridges et al. |
| RE30,019 | E | | 6/1979 | Lindquist |
| 4,160,479 | A | | 7/1979 | Richardson et al. |
| 4,160,481 | A | | 7/1979 | Turk et al. |
| 4,174,752 | A | | 11/1979 | Slater et al. |
| 4,191,252 | A | | 3/1980 | Buckley et al. |
| 4,202,168 | A | | 5/1980 | Acheson et al. |
| 4,202,169 | A | | 5/1980 | Acheson et al. |
| 4,212,353 | A | | 7/1980 | Hall |
| 4,217,956 | A | | 8/1980 | Goss et al. |
| 4,228,853 | A | | 10/1980 | Harvey et al. |
| 4,228,854 | A | | 10/1980 | Sacuta |
| 4,228,856 | A | | 10/1980 | Reale |
| 4,246,966 | A | | 1/1981 | Stoddard et al. |
| 4,248,302 | A | | 2/1981 | Churchman |
| 4,249,602 | A | | 2/1981 | Burton, III et al. |
| 4,250,964 | A | | 2/1981 | Jewell et al. |
| 4,252,194 | A | | 2/1981 | Felber et al. |
| 4,257,650 | A | | 3/1981 | Allen |
| 4,260,018 | A | | 4/1981 | Shum et al. |
| 4,262,745 | A | | 4/1981 | Stewart |
| 4,265,310 | A | | 5/1981 | Britton et al. |
| 4,270,609 | A | | 6/1981 | Choules |
| 4,271,905 | A | | 6/1981 | Redford et al. |
| 4,274,487 | A | | 6/1981 | Hollingsworth et al. |
| 4,280,559 | A | | 7/1981 | Best |
| 4,282,929 | A | | 8/1981 | Krajicek |
| 4,284,139 | A | | 8/1981 | Sweany |
| RE30,738 | E | | 9/1981 | Bridges et al. |
| 4,289,203 | A | | 9/1981 | Swanson |
| 4,296,814 | A | | 10/1981 | Stalder et al. |

4,300,634 A 11/1981 Clampitt
4,303,126 A 12/1981 Blevins
4,305,463 A 12/1981 Zakiewicz
4,306,981 A 12/1981 Blair, Jr.
4,319,632 A 3/1982 Marr, Jr.
4,319,635 A 3/1982 Jones
4,325,432 A 4/1982 Henry
4,326,968 A 4/1982 Blair, Jr.
4,327,805 A 5/1982 Poston
4,330,038 A 5/1982 Soukup et al.
4,333,529 A 6/1982 McCorquodale
4,344,483 A 8/1982 Fisher et al.
4,344,485 A 8/1982 Butler
4,344,486 A 8/1982 Parrish
4,345,652 A 8/1982 Roque
4,362,213 A 12/1982 Tabor
4,372,386 A 2/1983 Rhoades et al.
4,379,489 A 4/1983 Rollmann
4,379,592 A 4/1983 Vakhnin et al.
4,380,265 A 4/1983 Mohaupt
4,380,267 A 4/1983 Fox
4,381,124 A 4/1983 Verty et al.
4,382,469 A 5/1983 Bell et al.
4,385,661 A 5/1983 Fox
4,387,016 A 6/1983 Gagon
4,389,320 A 6/1983 Clampitt
4,390,062 A 6/1983 Fox
4,390,067 A 6/1983 Willman
4,392,530 A 7/1983 Odeh et al.
4,393,937 A 7/1983 Dilgren et al.
4,396,063 A 8/1983 Godbey
4,398,602 A 8/1983 Anderson
4,406,499 A 9/1983 Yildirim
4,407,367 A 10/1983 Kydd
4,410,216 A 10/1983 Allen
4,411,618 A 10/1983 Donaldson et al.
4,412,585 A 11/1983 Bouck
4,415,034 A 11/1983 Bouck
4,417,620 A 11/1983 Shafir
4,418,752 A 12/1983 Boyer et al.
4,423,779 A 1/1984 Livingston
4,427,528 A 1/1984 Lindörfer et al.
4,429,744 A 2/1984 Cook
4,429,745 A 2/1984 Cook
4,434,851 A 3/1984 Haynes, Jr. et al.
4,441,555 A 4/1984 Shu
4,444,257 A 4/1984 Stine
4,444,261 A 4/1984 Islip
4,445,573 A 5/1984 McCaleb
4,448,251 A 5/1984 Stine
4,450,909 A 5/1984 Sacuta
4,450,911 A 5/1984 Shu et al.
4,452,491 A 6/1984 Seglin et al.
4,453,597 A 6/1984 Brown et al.
4,456,065 A 6/1984 Heim et al.
4,456,066 A 6/1984 Shu
4,456,068 A 6/1984 Burrill, Jr. et al.
4,458,756 A 7/1984 Clark
4,458,759 A 7/1984 Isaacs et al.
4,460,044 A 7/1984 Porter
4,463,803 A * 8/1984 Wyatt ..... 166/59
4,465,137 A 8/1984 Sustek, Jr. et al.
4,466,485 A 8/1984 Shu
4,469,177 A 9/1984 Venkatesan
4,471,839 A 9/1984 Snavely et al.
4,473,114 A 9/1984 Bell et al.
4,475,592 A 10/1984 Pachovsky
4,475,595 A 10/1984 Watkins et al.
4,478,280 A 10/1984 Hopkins et al.
4,478,705 A 10/1984 Ganguli
4,480,689 A 11/1984 Wunderlich
4,484,630 A 11/1984 Chung
4,485,868 A 12/1984 Sresty et al.
4,487,262 A 12/1984 Venkatesan et al.
4,487,264 A 12/1984 Hyne et al.
4,488,600 A 12/1984 Fan
4,488,976 A 12/1984 Dilgren et al.
4,491,180 A 1/1985 Brown et al.
4,498,537 A 2/1985 Cook
4,498,542 A 2/1985 Eisenhawer et al.
4,499,946 A 2/1985 Martin et al.
4,501,325 A 2/1985 Frazier et al.
4,501,326 A 2/1985 Edmunds
4,501,445 A 2/1985 Gregoli
4,503,910 A 3/1985 Shu
4,503,911 A 3/1985 Hartman et al.
4,508,170 A 4/1985 Littmann
4,513,819 A 4/1985 Islip et al.
4,515,215 A 5/1985 Hermes et al.
4,516,636 A 5/1985 Doscher
4,522,260 A 6/1985 Wolcott, Jr.
4,522,263 A 6/1985 Hopkins et al.
4,524,826 A 6/1985 Savage
4,528,104 A 7/1985 House et al.
4,530,401 A 7/1985 Hartman et al.
4,532,993 A 8/1985 Dilgren et al.
4,532,994 A 8/1985 Toma et al.
4,535,845 A 8/1985 Brown et al.
4,540,049 A 9/1985 Hawkins et al.
4,540,050 A 9/1985 Huang et al.
4,545,435 A 10/1985 Bridges et al.
4,546,829 A 10/1985 Martin et al.
4,550,779 A 11/1985 Zakiewicz
4,556,107 A 12/1985 Duerksen et al.
4,558,740 A 12/1985 Yellig, Jr.
4,565,245 A 1/1986 Mims et al.
4,565,249 A 1/1986 Pebdani et al.
4,572,296 A 2/1986 Watkins
4,574,884 A 3/1986 Schmidt
4,574,886 A 3/1986 Hopkins et al.
4,577,688 A 3/1986 Gassmann et al.
4,579,176 A 4/1986 Davies et al.
4,589,487 A 5/1986 Venkatesan et al.
4,595,057 A 6/1986 Deming et al.
4,597,441 A 7/1986 Ware et al.
4,597,443 A 7/1986 Shu et al.
4,598,770 A 7/1986 Shu et al.
4,601,337 A 7/1986 Lau et al.
4,601,338 A 7/1986 Prats et al.
4,607,695 A 8/1986 Weber
4,607,699 A 8/1986 Stephens
4,607,700 A 8/1986 Duerksen et al.
4,610,304 A 9/1986 Doscher
4,612,989 A 9/1986 Rakach et al.
4,612,990 A 9/1986 Shu
4,615,391 A 10/1986 Garthoffner
4,620,592 A 11/1986 Perkins
4,620,593 A 11/1986 Haagensen
4,635,720 A 1/1987 Chew
4,637,461 A 1/1987 Hight
4,637,466 A 1/1987 Hawkins et al.
4,640,352 A 2/1987 Vanmeurs et al.
4,640,359 A 2/1987 Livesey et al.
4,641,710 A 2/1987 Klinger
4,645,003 A 2/1987 Huang et al.
4,645,004 A 2/1987 Bridges et al.
4,646,824 A 3/1987 Huang et al.
4,648,835 A 3/1987 Eisenhawer et al.
4,651,825 A 3/1987 Wilson
4,651,826 A 3/1987 Holmes
4,653,583 A 3/1987 Huang et al.
4,662,438 A 5/1987 Taflove et al.
4,662,440 A 5/1987 Harmon et al.
4,662,441 A 5/1987 Huang et al.
4,665,989 A 5/1987 Wilson
4,667,739 A 5/1987 Van Meurs et al.

4,679,626 A 7/1987 Perkins
4,682,652 A 7/1987 Huang et al.
4,682,653 A 7/1987 Angstadt
4,685,515 A 8/1987 Huang et al.
4,687,058 A 8/1987 Casad et al.
4,690,215 A 9/1987 Roberts et al.
4,691,773 A 9/1987 Ward et al.
4,693,311 A 9/1987 Muijs et al.
4,694,907 A 9/1987 Stahl et al.
4,697,642 A 10/1987 Vogel
4,699,213 A 10/1987 Fleming
4,700,779 A 10/1987 Huang et al.
4,702,314 A 10/1987 Huang et al.
4,702,317 A 10/1987 Shen
4,705,108 A 11/1987 Little et al.
4,706,751 A 11/1987 Gondouin
4,707,230 A 11/1987 Ajami
4,718,485 A 1/1988 Brown et al.
4,718,489 A 1/1988 Hallam et al.
4,726,759 A * 2/1988 Wegener ..... 431/4
4,727,489 A 2/1988 Frazier et al.
4,727,937 A 3/1988 Shum et al.
4,739,831 A 4/1988 Settlemeyer et al.
4,753,293 A 6/1988 Bohn
4,756,369 A 7/1988 Jennings, Jr. et al.
4,757,833 A 7/1988 Danley
4,759,571 A 7/1988 Stone et al.
4,766,958 A 8/1988 Faecke
4,769,161 A 9/1988 Angstadt
4,775,450 A 10/1988 Ajami
4,782,901 A 11/1988 Phelps et al.
4,785,028 A 11/1988 Hoskin et al.
4,785,883 A 11/1988 Hoskin et al.
4,787,452 A 11/1988 Jennings, Jr.
4,793,415 A 12/1988 Holmes et al.
4,804,043 A 2/1989 Shu et al.
4,809,780 A 3/1989 Shen
4,813,483 A 3/1989 Ziegler
4,817,711 A 4/1989 Jeambey
4,817,714 A 4/1989 Jones
4,818,370 A 4/1989 Gregoli et al.
4,828,030 A 5/1989 Jennings, Jr.
4,828,031 A 5/1989 Davis
4,828,032 A 5/1989 Teletzke et al.
4,834,174 A 5/1989 Vandevier
4,834,179 A 5/1989 Kokolis et al.
4,844,155 A 7/1989 Megyeri et al.
4,846,275 A 7/1989 McKay
4,850,429 A 7/1989 Mims et al.
4,856,586 A 8/1989 Phelps et al.
4,856,587 A 8/1989 Nielson
4,860,827 A 8/1989 Lee et al.
4,861,263 A 8/1989 Schirmer
4,867,238 A 9/1989 Bayless et al.
4,869,830 A 9/1989 Konak et al.
4,874,043 A 10/1989 Joseph et al.
4,884,635 A 12/1989 McKay et al.
4,886,118 A 12/1989 Van Meurs et al.
4,892,146 A 1/1990 Shen
4,895,085 A 1/1990 Chips
4,895,206 A 1/1990 Price
4,896,725 A 1/1990 Parker et al.
4,901,795 A 2/1990 Phelps et al.
4,903,766 A 2/1990 Shu
4,903,768 A 2/1990 Shu
4,903,770 A 2/1990 Friedman et al.
4,915,170 A 4/1990 Hoskin
4,919,206 A 4/1990 Freeman et al.
4,926,941 A 5/1990 Glandt et al.
4,926,943 A 5/1990 Hoskin
4,928,766 A 5/1990 Hoskin
4,930,454 A 6/1990 Latty et al.
4,940,091 A 7/1990 Shu et al.
4,945,984 A 8/1990 Price
4,947,933 A 8/1990 Jones et al.
4,961,467 A 10/1990 Pebdani
4,962,814 A 10/1990 Alameddine
4,964,461 A 10/1990 Shu
4,966,235 A 10/1990 Gregoli et al.
4,969,520 A 11/1990 Jan et al.
4,974,677 A 12/1990 Shu
4,982,786 A 1/1991 Jennings, Jr.
4,983,364 A 1/1991 Buck et al.
4,991,652 A 2/1991 Hoskin et al.
5,010,953 A 4/1991 Friedman et al.
5,013,462 A 5/1991 Danley
5,014,787 A 5/1991 Duerksen
5,016,709 A 5/1991 Combe et al.
5,016,710 A 5/1991 Renard et al.
5,016,713 A 5/1991 Sanchez et al.
5,024,275 A 6/1991 Anderson et al.
5,027,898 A 7/1991 Naae
5,036,915 A 8/1991 Wyganowski
5,036,917 A 8/1991 Jennings, Jr. et al.
5,036,918 A 8/1991 Jennings, Jr. et al.
5,040,605 A 8/1991 Showalter
5,042,579 A 8/1991 Glandt et al.
5,046,559 A 9/1991 Glandt
5,046,560 A 9/1991 Teletzke et al.
5,052,482 A 10/1991 Gondouin
5,054,551 A 10/1991 Duerksen
5,055,030 A * 10/1991 Schirmer ..... 431/10
5,056,596 A 10/1991 McKay et al.
5,058,681 A 10/1991 Reed
5,060,726 A 10/1991 Glandt et al.
5,065,819 A 11/1991 Kasevich
5,083,612 A 1/1992 Ashrawi
5,083,613 A 1/1992 Gregoli et al.
5,085,275 A 2/1992 Gondouin
5,099,918 A 3/1992 Bridges et al.
5,101,898 A 4/1992 Hong
5,105,880 A 4/1992 Shen
5,109,927 A 5/1992 Supernaw et al.
5,123,485 A 6/1992 Vasicek et al.
5,131,471 A 7/1992 Duerksen et al.
5,145,002 A 9/1992 McKay
5,145,003 A 9/1992 Duerksen
5,148,869 A 9/1992 Sanchez
5,156,214 A 10/1992 Hoskin et al.
5,167,280 A 12/1992 Sanchez et al.
5,172,763 A 12/1992 Mohammadi et al.
5,174,377 A 12/1992 Kumar
5,178,217 A 1/1993 Mohammadi et al.
5,186,256 A 2/1993 Downs
5,199,490 A 4/1993 Surles et al.
5,201,815 A 4/1993 Hong et al.
5,215,146 A 6/1993 Sanchez
5,215,149 A 6/1993 Lu
5,236,039 A 8/1993 Edelstein et al.
5,238,066 A 8/1993 Beattie et al.
5,246,071 A 9/1993 Chu
5,247,993 A 9/1993 Sarem et al.
5,252,226 A 10/1993 Justice
5,271,693 A 12/1993 Johnson et al.
5,273,111 A 12/1993 Brannan et al.
5,277,830 A 1/1994 Hoskin et al.
5,279,367 A 1/1994 Osterloh
5,282,508 A 2/1994 Ellingsen et al.
5,289,881 A 3/1994 Schuh
5,293,936 A 3/1994 Bridges
5,295,540 A 3/1994 Djabbarah et al.
5,297,627 A 3/1994 Sanchez et al.
5,305,829 A 4/1994 Kumar
5,318,124 A 6/1994 Ong et al.
5,325,918 A 7/1994 Berryman et al.
5,339,897 A 8/1994 Leaute 5,339,898 A 8/1994 Yu et al.
5,339,904 A 8/1994 Jennings, Jr. et al.
5,350,014 A 9/1994 McKay
5,358,054 A 10/1994 Bert
5,361,845 A 11/1994 Jamaluddin et al.
5,377,757 A 1/1995 Ng
5,404,950 A 4/1995 Ng et al.
5,407,009 A 4/1995 Butler et al.
5,411,086 A 5/1995 Burcham et al.
5,411,089 A 5/1995 Vinegar et al.
5,411,094 A 5/1995 Northrop
5,413,175 A 5/1995 Edmunds
5,415,231 A 5/1995 Northrop et al.
5,417,283 A 5/1995 Ejiogu et al.
5,431,224 A 7/1995 Laali
5,433,271 A 7/1995 Vinegar et al.
5,449,038 A 9/1995 Horton et al.
5,450,902 A 9/1995 Matthews
5,456,315 A 10/1995 Kisman et al.
5,458,193 A 10/1995 Horton et al.
5,464,309 A 11/1995 Mancini et al.
5,483,801 A 1/1996 Craze
5,503,226 A 4/1996 Wadleigh
5,511,616 A 4/1996 Bert
5,513,705 A 5/1996 Djabbarah et al.
5,531,272 A 7/1996 Ng et al.
5,534,186 A 7/1996 Walker et al.
5,547,022 A 8/1996 Juprasert et al.
5,553,974 A 9/1996 Nazarian
5,560,737 A 10/1996 Schuring et al.
5,565,139 A 10/1996 Walker et al.
5,589,775 A 12/1996 Kuckes
5,607,016 A 3/1997 Butler
5,607,018 A 3/1997 Schuh
5,626,191 A 5/1997 Greaves et al.
5,626,193 A 5/1997 Nzekwu et al.
5,635,139 A 6/1997 Holst et al.
5,650,128 A 7/1997 Holst et al.
5,660,500 A 8/1997 Marsden, Jr. et al.
5,677,267 A 10/1997 Suarez et al.
5,682,613 A 11/1997 Dinatale
5,709,505 A 1/1998 Williams et al.
5,713,415 A 2/1998 Bridges
5,738,937 A 4/1998 Baychar
5,765,964 A 6/1998 Calcote et al.
5,771,973 A 6/1998 Jensen et al.
5,788,412 A 8/1998 Jatkar
RE35,891 E 9/1998 Jamaluddin et al.
5,803,171 A 9/1998 McCaffery et al.
5,803,178 A 9/1998 Cain
5,813,799 A 9/1998 Calcote et al.
5,823,631 A 10/1998 Herbolzheimer et al.
5,860,475 A 1/1999 Ejiogu et al.
5,899,274 A 5/1999 Frauenfeld et al.
5,923,170 A 7/1999 Kuckes
5,931,230 A 8/1999 Lesage et al.
5,941,081 A 8/1999 Burgener
5,957,202 A 9/1999 Huang
5,984,010 A 11/1999 Elias et al.
6,000,471 A 12/1999 Langset
6,004,451 A 12/1999 Rock et al.
6,012,520 A 1/2000 Yu et al.
6,015,015 A 1/2000 Luft et al.
6,016,867 A 1/2000 Gregoli et al.
6,016,868 A 1/2000 Gregoli et al.
6,026,914 A 2/2000 Adams et al.
6,039,121 A 3/2000 Kisman
6,048,810 A 4/2000 Baychar
6,050,335 A 4/2000 Parsons
6,056,057 A 5/2000 Vinegar et al.
6,102,122 A 8/2000 de Rouffignac
6,109,358 A 8/2000 McPhee et al.
6,148,911 A 11/2000 Gipson et al.
6,158,510 A 12/2000 Bacon et al.
6,158,513 A 12/2000 Nistor et al.
6,167,966 B1 1/2001 Ayasse et al.
6,173,775 B1 1/2001 Elias et al.
6,186,232 B1 2/2001 Isaacs et al.
6,189,611 B1 2/2001 Kasevich
6,205,289 B1 3/2001 Kobro
6,230,814 B1 5/2001 Nasr et al.
6,257,334 B1 7/2001 Cyr et al.
6,263,965 B1 7/2001 Schmidt et al.
6,276,457 B1 8/2001 Moffatt et al.
6,285,014 B1 9/2001 Beck et al.
6,305,472 B2 10/2001 Richardson et al.
6,318,464 B1 11/2001 Mokrys
6,325,147 B1 12/2001 Doerler et al.
6,328,104 B1 12/2001 Graue
6,353,706 B1 3/2002 Bridges
6,357,526 B1 3/2002 Abdel-Halim et al.
6,409,226 B1 6/2002 Slack et al.
6,412,557 B1 7/2002 Ayasse et al.
6,413,016 B1 7/2002 Nelson et al.
6,454,010 B1 9/2002 Thomas et al.
6,536,523 B1 3/2003 Kresnyak et al.
6,554,067 B1 4/2003 Davies et al.
6,561,274 B1 5/2003 Hayes et al.
6,581,684 B2 6/2003 Wellington et al.
6,588,500 B2 7/2003 Lewis
6,591,906 B2 7/2003 Wellington et al.
6,591,908 B2 7/2003 Nasr
6,607,036 B2 8/2003 Ranson et al.
6,631,761 B2 10/2003 Yuan et al.
6,662,872 B2 12/2003 Gutek et al.
6,666,666 B1 12/2003 Gilbert et al.
6,681,859 B2 1/2004 Hill
6,688,387 B1 2/2004 Wellington et al.
6,702,016 B2 3/2004 de Rouffignac et al.
6,712,136 B2 3/2004 de Rouffignac et al.
6,712,150 B1 3/2004 Misselbrook et al.
6,715,546 B2 4/2004 Vinegar et al.
6,715,547 B2 4/2004 Vinegar et al.
6,715,548 B2 4/2004 Wellington et al.
6,715,549 B2 4/2004 Wellington et al.
6,719,047 B2 4/2004 Fowler et al.
6,722,429 B2 4/2004 de Rouffignac et al.
6,722,431 B2 4/2004 Karanikas et al.
6,725,920 B2 4/2004 Zhang et al.
6,729,394 B1 5/2004 Hassan et al.
6,729,395 B2 5/2004 Shahin, Jr. et al.
6,729,397 B2 5/2004 Zhang et al.
6,729,401 B2 5/2004 Vinegar et al.
6,732,794 B2 5/2004 Wellington et al.
6,732,795 B2 5/2004 de Rouffignac et al.
6,732,796 B2 5/2004 Vinegar et al.
6,733,636 B1 5/2004 Heins
6,736,215 B2 5/2004 Maher et al.
6,736,222 B2 5/2004 Kuckes et al.
6,739,394 B2 5/2004 Vinegar et al.
6,742,588 B2 6/2004 Wellington et al.
6,742,593 B2 6/2004 Vinegar et al.
6,745,831 B2 6/2004 de Rouffignac et al.
6,745,832 B2 6/2004 Wellington et al.
6,745,837 B2 6/2004 Wellington et al.
6,755,246 B2 6/2004 Chen et al.
6,758,268 B2 7/2004 Vinegar et al.
6,782,947 B2 8/2004 de Rouffignac et al.
6,789,625 B2 9/2004 de Rouffignac et al.
6,794,864 B2 9/2004 Mirotchnik et al.
6,805,195 B2 10/2004 Vinegar et al.
6,814,141 B2 11/2004 Huh et al.
2001/0009830 A1 7/2001 Baychar
2001/0017206 A1 8/2001 Davidson et al.
2001/0018975 A1 9/2001 Richardson et al.
2002/0029881 A1 3/2002 de Rouffignac et al.

2002/0033253 A1 3/2002 Rouffignac et al.
2002/0038710 A1 4/2002 Maher et al.
2002/0040779 A1 4/2002 Wellington et al.
2002/0046838 A1 4/2002 Karanikas et al.
2002/0056551 A1 5/2002 Wellington et al.
2002/0104651 A1 8/2002 McClung, III
2002/0148608 A1 10/2002 Shaw
2002/0157831 A1 10/2002 Kurlenya et al.
2003/0000711 A1 1/2003 Gutek et al.
2003/0009297 A1 1/2003 Mirotchnik et al.
2003/0015458 A1 1/2003 Nenniger et al.
2003/0042018 A1 3/2003 Huh et al.
2003/0044299 A1 3/2003 Thomas et al.
2003/0051875 A1 3/2003 Wilson
2003/0062159 A1 4/2003 Nasr
2003/0062717 A1 4/2003 Thomas et al.
2003/0079877 A1 5/2003 Wellington et al.
2003/0080604 A1 5/2003 Vinegar et al.
2003/0090424 A1 5/2003 Brune et al.
2003/0098605 A1 5/2003 Vinegar et al.
2003/0102123 A1 6/2003 Wittle et al.
2003/0102124 A1 6/2003 Vinegar et al.
2003/0102126 A1 6/2003 Sumnu-Dindoruk et al.
2003/0102130 A1 6/2003 Vinegar et al.
2003/0111223 A1 6/2003 Rouffignac et al.
2003/0116315 A1 6/2003 Wellington et al.
2003/0127226 A1 7/2003 Heins
2003/0129895 A1 7/2003 Baychar
2003/0131993 A1 7/2003 Zhang et al.
2003/0131994 A1 7/2003 Vinegar et al.
2003/0131995 A1 7/2003 de Rouffignac et al.
2003/0131996 A1 7/2003 Vinegar et al.
2003/0136476 A1 7/2003 O'Hara et al.
2003/0141053 A1 7/2003 Yuan et al.
2003/0141065 A1 7/2003 Karanikas et al.
2003/0141066 A1 7/2003 Karanikas et al.
2003/0141067 A1 7/2003 Rouffignac et al.
2003/0141068 A1 7/2003 Pierre de Rouffignac et al.
2003/0155111 A1 8/2003 Vinegar et al.
2003/0159828 A1 8/2003 Howard et al.
2003/0164234 A1 9/2003 de Rouffignac et al.
2003/0164239 A1 9/2003 Wellington et al.
2003/0173072 A1 9/2003 Vinegar et al.
2003/0173080 A1 9/2003 Berchenko et al.
2003/0173081 A1 9/2003 Vinegar et al.
2003/0173082 A1 9/2003 Vinegar et al.
2003/0173086 A1 9/2003 Howard et al.
2003/0178191 A1 9/2003 Maher et al.
2003/0183390 A1 10/2003 Veenstra et al.
2003/0192691 A1 10/2003 Vinegar et al.
2003/0192693 A1 10/2003 Wellington
2003/0196788 A1 10/2003 Vinegar et al.
2003/0196789 A1 10/2003 Wellington et al.
2003/0196801 A1 10/2003 Vinegar et al.
2003/0196810 A1 10/2003 Vinegar et al.
2003/0201098 A1 10/2003 Karanikas et al.
2003/0205378 A1 11/2003 Wellington et al.
2003/0209348 A1 11/2003 Ward et al.
2003/0223896 A1 12/2003 Gilbert et al.
2004/0007500 A1 1/2004 Kresnyak
2004/0020642 A1 2/2004 Vinegar et al.
2004/0040715 A1 3/2004 Wellington et al.
2004/0050547 A1 3/2004 Limbach
2004/0112586 A1 6/2004 Matthews et al.
2004/0116304 A1 6/2004 Wu et al.
2004/0118783 A1 6/2004 Myers et al.
2004/0140095 A1 7/2004 Vinegar et al.
2004/0140096 A1 7/2004 Sandberg et al.
2004/0144540 A1 7/2004 Sandberg et al.
2004/0144541 A1 7/2004 Picha et al.
2004/0145969 A1 7/2004 Bai et al.
2004/0146288 A1 7/2004 Vinegar et al.
2004/0154793 A1 8/2004 Zapadinski
2004/0177966 A1 9/2004 Vinegar et al.
2004/0204324 A1 10/2004 Baltoiu et al.
2004/0211554 A1 10/2004 Vinegar et al.
2004/0211569 A1 10/2004 Vinegar et al.
2004/0261729 A1 12/2004 Sarkar
2005/0006097 A1 1/2005 Sandberg et al.
2005/0026094 A1* 2/2005 Sanmiguel et al. ..... 431/1

FOREIGN PATENT DOCUMENTS

EP 0 144 203 A2 6/1985
EP 0 158 486 A1 10/1985
EP 0 226 275 A1 6/1987
EP 0 261 793 A1 3/1988
EP 0 269 231 A1 6/1988
EP 0 283 602 A1 9/1988
EP 0 295 712 A2 12/1988
EP 0 341 976 A2 11/1989
EP 0 387 846 A1 9/1990
EP 0 420 656 A2 4/1991
EP 0 747 142 A1 12/1996
FR 2 852 713 9/2004
GB 1 457 696 12/1976
GB 1 463 444 2/1977
GB 2 031 975 4/1980
GB 1 585 742 3/1981
GB 2 062 065 5/1981
GB 2 138 869 10/1984
GB 2 156 400 10/1985
GB 2 164 978 4/1986
GB 2 177 141 1/1987
GB 2 196 665 5/1988
GB 2 219 818 12/1989
GB 2 257 184 1/1993
GB 2 272 465 5/1994
GB 2 286 001 8/1995
GB 2 340 152 2/2000
GB 2 357 528 6/2001
GB 2 362 333 11/2001
GB 2 363 587 1/2002
GB 2 391 890 2/2004
GB 2 391 891 2/2004
GB 2 403 443 12/2004
WO WO 82/01214 4/1982
WO WO 86/03251 6/1986
WO WO 87/07293 12/1987
WO WO 89/12728 12/1989
WO WO 92/18748 10/1992
WO WO 93/16338 8/1993
WO WO 93/23134 11/1993
WO WO 94/21886 9/1994
WO WO 94/21889 9/1994
WO WO 95/16512 6/1995
WO WO 96/16729 6/1996
WO WO 96/32566 10/1996
WO WO 96/35858 11/1996
WO WO 97/01017 1/1997
WO WO 97/12119 4/1997
WO WO 97/35090 9/1997
WO WO 98/04807 2/1998
WO WO 98/37306 8/1998
WO WO 98/40603 9/1998
WO WO 98/40605 9/1998
WO WO 98/45733 10/1998
WO WO 98/50679 11/1998
WO WO 99/30002 6/1999
WO WO 99/67503 12/1999
WO WO 99/67504 12/1999
WO WO 99/67505 12/1999
WO WO 00/23688 4/2000
WO WO 00/25002 5/2000
WO WO 00/66882 11/2000
WO WO 00/67930 11/2000

| | | | |
|---|---|---|---|
| WO | WO 01/06089 | A1 | 1/2001 |
| WO | WO 01/27439 | A1 | 4/2001 |
| WO | WO 01/81239 | A2 | 11/2001 |
| WO | WO 01/81505 | A1 | 11/2001 |
| WO | WO 01/81710 | A1 | 11/2001 |
| WO | WO 01/81715 | A2 | 11/2001 |
| WO | WO 01/92673 | A2 | 12/2001 |
| WO | WO 01/92684 | A1 | 12/2001 |
| WO | WO 01/92768 | A2 | 12/2001 |
| WO | WO 02/086018 | A2 | 10/2002 |
| WO | WO 02/086276 | A2 | 10/2002 |
| WO | WO 03/010415 | A1 | 2/2003 |
| WO | WO 03/036033 | A1 | 5/2003 |
| WO | WO 03/036038 | A2 | 5/2003 |
| WO | WO 03/036039 | A1 | 5/2003 |
| WO | WO 03/036043 | A2 | 5/2003 |
| WO | WO 03/038230 | A2 | 5/2003 |
| WO | WO 03/038233 | A1 | 5/2003 |
| WO | WO 03/040513 | A2 | 5/2003 |
| WO | WO 03/040762 | A1 | 5/2003 |
| WO | WO 03/053603 | A2 | 7/2003 |
| WO | WO 03/054351 | A1 | 7/2003 |
| WO | WO 03/062596 | A1 | 7/2003 |
| WO | WO 03/100257 | A1 | 12/2003 |
| WO | WO 2004/038173 | A1 | 5/2004 |
| WO | WO 2004/038174 | A2 | 5/2004 |
| WO | WO 2004/038175 | A1 | 5/2004 |
| WO | WO 2004/050567 | A1 | 6/2004 |
| WO | WO 2004/050791 | A1 | 6/2004 |
| WO | WO 2004/097159 | A2 | 11/2004 |
| WO | WO 2005/007776 | A1 | 1/2005 |
| WO | WO 2005/012688 | A1 | 2/2005 |

OTHER PUBLICATIONS

Gary R. Greaser and J. Raul Ortiz, "New Thermal Recovery Technology and Technology Transfer for Successful Heavy Oil Development," SPE 69731, Copyright 2003, Society of Petroleum Engineers, Inc., 7 pages.

A.J. Mulac, J.A. Beyeloer, R.G. Clay, K.R. Darnall, A.B. Donaldson, T.D. Donham, R.L. Fox, D.R. Johnson and R.L. Maxwell, "Project Deep Steam Preliminary Field Test Bakersfield, California," SAND80-2843, Printed Apr. 1981, 62 pages.

Website: http://www.oceaneering.com/Brochures/MFX%20-%Oceaneering%20Multiflex.pdf, Oceaneering Multiflex, Oceaneering International, Incorporated, printed Nov. 23, 2005.

Notification of Transmittal of the International Search Report and the Written Opinion of the International Searching Authority, or the Declaration (2 pages), International Search Report (5 pages), and Written Opinion of the International Searching Authority (6 pages) for International Application No. PCT/US2006/031802 dated Dec. 15, 2006.

NTIS Downhole Steam-Generator Study. vol. 1 Conception and Feasibility Evaluation. Final Report Sep. 1978-Sep. 1980 Sandia National Labs Albuquerque NM Jun. 1982. 260 pages.

Notification Concerning Transmittal of International Preliminary Report on Patentability (Chapter 1 of the Patent Cooperation Treaty) (1 page), International Preliminary Report on Patentability (1 page), and Written Opinion of the International Searching Authority (6 pages), for International Application No. PCT/US2006/031802 mailed Feb. 28, 2008.

* cited by examiner

COMMUNICATING FLUIDS WITH A HEATED-FLUID GENERATION SYSTEM

TECHNICAL FIELD

This documents relates to a tube system for use in a wellbore, such as for use in the delivery of fluids to a downhole heated-fluid generator device.

BACKGROUND

Fluids in hydrocarbon formations may be accessed via wellbores that extend down into the ground toward the targeted formations. In some cases, the hydrocarbon formations may have a lower viscosity such that crude oil flows from the formation, through production tubing, and toward the production equipment at the ground surface. Some hydrocarbon formations comprise fluids having a higher viscosity, which may not freely flow from the formation and through the production tubing. These high viscosity fluids in the hydrocarbon formations are occasionally referred to as "heavy oil deposits." In the past, the high viscosity fluids in the hydrocarbon formations remained untapped due to the inability and expense of recovering them. More recently, as the demand for crude oil has increased, the commercial operations have expanded to the recovery of such heavy oil deposits.

In some circumstances, the application of heated fluids (e.g., steam) to the hydrocarbon formation may reduce the viscosity of the fluids in the formation so as to permit the extraction of crude oil and other liquids from the formation. The design of systems to deliver the steam to the hydrocarbon formations may be affected by a number of factors.

One such factor is the location of the steam generators. If the steam generator is located above the ground surface, steam boilers may be used to create the steam while a long tube extends therefrom to deliver the steam down the wellbore to the targeted formation. Because a substantial portion of the heat energy from the steam may be dissipated as the steam is transported down the wellbore, the requisite energy to generate the steam may be costly and the overall system can be inefficient. If, in the alternative, the steam generators are located downhole (e.g., in the wellbore below the ground surface), the heat energy from the steam may be more efficiently transferred to the hydrocarbon formation, but the amount of heat and steam generated by the downhole device may be limited by the size and orientation of the downhole steam generator and by constraints on the supply of water and fuels. Furthermore, installation of the downhole steam generators, including the attachment of supply tubes that provide water, air, fuel, or the like from the ground surface, may be complex and time consuming.

SUMMARY

Some embodiments of a supply tube system for use in a wellbore may have multiple tubes—a number of which can be readily coupled to a downhole steam generator or other heated-fluid generator device. In certain embodiments, the system may include a connector that simplifies the process of coupling the supply tube system to the steam generator and provides for fluid communication between each supply conduit and the associated input port of the steam generator.

One aspect encompasses a method in which a heated-fluid generator device is lowered into a wellbore coupled to a first tube. The first tube supports at least a portion of a weight of the heated-fluid generator device while lowering the heated-fluid generator device into the wellbore. A second tube is coupled to the heated-fluid generator. One of the first and second tubes is disposed inside of the other tube to define a first fluid conduit inside of a second fluid conduit. At least one of the first tube and the second tube comprises a coiled tubing uncoiled from a spool and inserted into the wellbore.

Another aspect encompasses a method in which a heated-fluid generator device is lowered into a wellbore coupled to a first tube. The first tube supports at least a portion of a weight of the heated-fluid generator device while it is being lowered into the wellbore. The first tube is uncoiled from a spool as the heated-fluid generator device is lowered into the wellbore. A second tube is coupled to the heated-fluid generator such that one of the first and second tubes is nested within the other to define at least a portion of at least two fluid conduits.

Another aspect encompasses a system for generating heated fluid in a wellbore. The system includes a heated-fluid generator device disposed in a wellbore and adapted to output a heated fluid. A first and second tubes reside in the wellbore and are coupled to the heated-fluid generator. The first tube resides within the second tube so as to define a inner fluid conduit disposed within an intermediate fluid conduit. Both the inner and intermediate conduits are in fluid communication with the heated-fluid generator device. At least one of the first and second tubes comprises a coiled tubing.

These and other embodiments may be configured to provide one or more of the following advantages. First, the supply tube system may efficiently use the space within the wellbore to deliver fluids, such as water, air, and fuel, to the downhole heated-fluid generator device. For example, the supply tube system may comprise a plurality conduits that are substantially coaxial to one another—with the outermost conduit being at least partially defined by the wellbore casing. In such circumstances, the space within the wellbore may be efficiently used to deliver the fluids to the heated-fluid generator device. Second, the supply tube system may be partially coupled to the heated-fluid generator device before it is lowered into the wellbore. For example, at least one tube of the supply tube system may be coupled to the heated-fluid generator device above the surface while another tube is subsequently coupled to the heated-fluid generator device after it has been lowered into the wellbore. In such circumstances, the supply tube system may be readily coupled to the heated-fluid generator device and may facilitate the process of lowering the heated-fluid generator device into the wellbore. One or more of these and other advantages may be provided by the devices and methods described herein.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1:
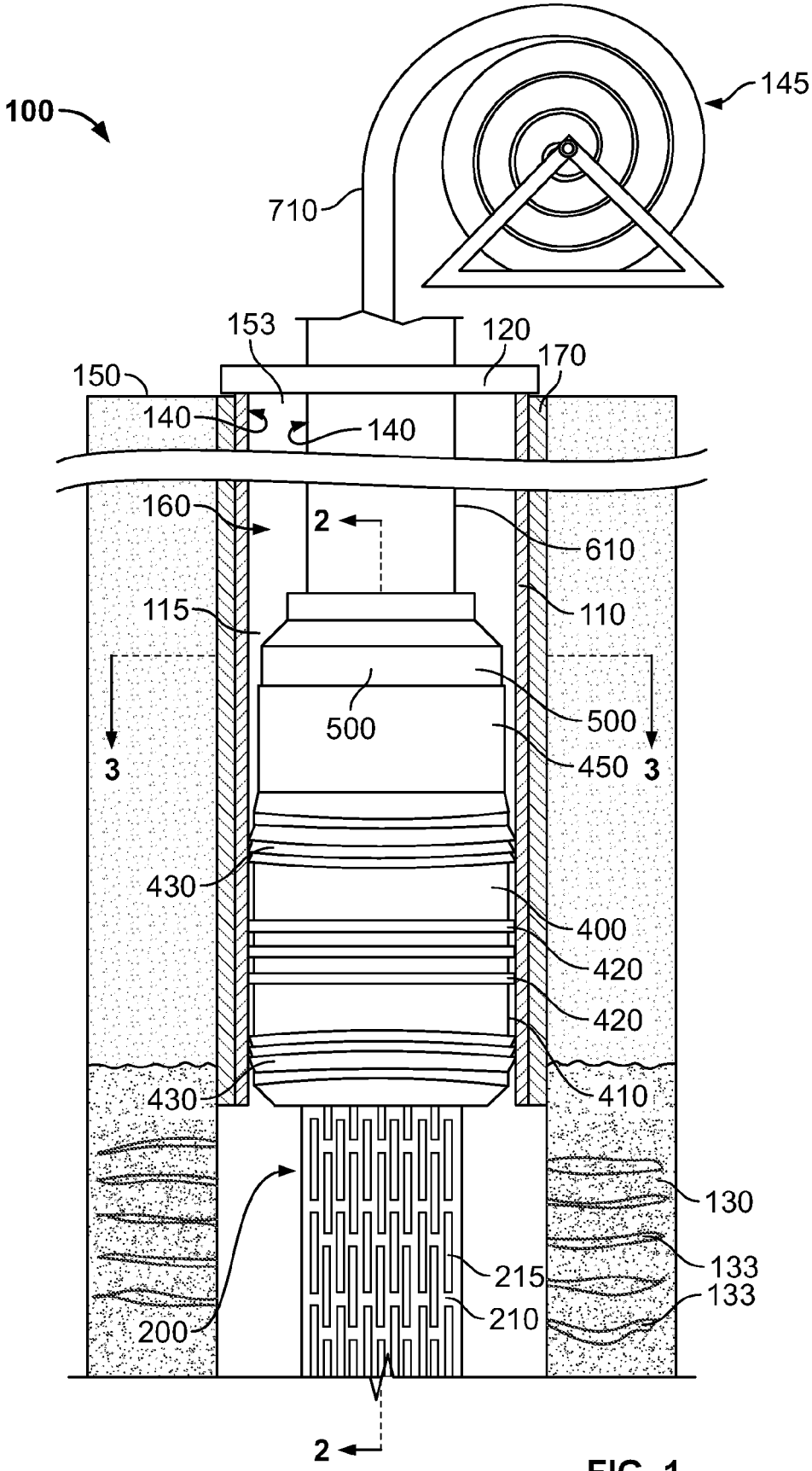
FIG. 1 is a side view of an embodiment of a supply tube system and a heated-fluid generator device in a well.

Referring to FIG. 1, a well 100 may include a well head 120 that is disposed proximal to a ground surface 150 and a wellbore 160. The well head 120 may be coupled to a casing 110 that extends a substantial portion of the length of the wellbore 160 from about the ground surface 150 towards a formation 130 (e.g., hydrocarbon-containing reservoir). In this embodiment the wellbore 160 extends in a substantially vertical direction toward the formation 130. It should be understood that, in other embodiments, at least a portion of the wellbore 160 may be curved or extend in a slanted or substantially horizontal direction. In some instances, the wellbore 160 may be formed by drilling from the surface 150 into the formation 130 and then lining the hole with the casing 110.

In some instances, some or all of the casing 110 may be affixed to the adjacent ground material with a cement jacket 170 or the like. The casing 110 may comprise metallic material. The casing 110 may be configured to carry a fluid, such as air, water, natural gas, or to carry an electrical line, tubular string, or other device. In some embodiments, the well 100 may be completed with the casing 110 extending to a predetermined depth proximal to the formation 130. A locating or pack-off device such as a liner hanger 400 (when deployed in the wellbore 160) can grip and, in some instances, substantially seal about the end of the casing 110. In such circumstances, a heated-fluid generator device 200 may be deployed so that the heated-fluid generator device 200 outputs heated fluid through an apertured liner 210 coupled to the liner hanger 400. The output heated fluid is thus exposed to the hydrocarbon producing formation proximal to the formation 130.

Still referring to FIG. 1, a heated-fluid generator device 200 may be at least partially disposed in the wellbore 160 proximal to the formation 130. The heated-fluid generator device 200 may be a device adapted to receive and heat an injection fluid. In one instance, the injection fluid includes water and the water may be heated to generate steam. The injection fluid can include other different fluids, in addition to or in lieu of water, and the injection fluid need not be heated to a vapor state (e.g. steam). The heated-fluid generator device 200 includes inputs to receive the injection fluid and other fluids (e.g., air, fuel such as natural gas, or both) and may have one of a number of configurations to deliver heated injection fluids to the formation 130. The heated-fluid generator device 200 may use fluids, such as air and natural gas, in a combustion or catalyzing process to heat the injection fluid (e.g., heat water into steam) that is applied to the formation 130. In some circumstances, the formation 130 may include high viscosity fluids, such as heavy oil deposits or the like. The heated-fluid generator device 200 may supply steam or another heated injection fluid to the formation 130, which may penetrate into the formation 130, for example, through fractures 133 in the formation 130. The application of a heated injection fluid to the formation 130 may reduce the viscosity of the fluids in the formation 130. In such embodiments, the fluids in the formation 130 may be more readily recovered by equipment at the ground surface 150.

In some instances, the formation 130 may be an injection formation in proximity of a producing formation, whereas the heated fluid injected into the formation 130 flows from the injection formation towards the producing formation, or through a combination of conduction and convection heats the fluids in the producing formation. The producing formation is intersected by a separate producing wellbore. The heated fluid reduces the viscosity of the hydrocarbon fluids in the producing formation, thus increasing the flowrate of the hydrocarbon fluids from the producing formation into the producing wellbore. In some instances the injection formation is above the producing formation, whereas gravity assists in bringing the heated injected fluid in contact with the producing formation. This configuration is often referred to as steam assisted gravity drainage (SAGD).

The heated-fluid generator device 200 may be in fluid communication with a supply tube system 140 having one or more supply tubes. As described in more detail below in connection with FIG. 2, the supply tubes may provide fluids or other items via conduits to the heated-fluid generator device 200. In some embodiments, a connector 500 may be used to join the supply tube system 140 to the heated-fluid generator device 200. Alternatively, the connector 500 may be integral with the heated-fluid generator device 200 so that the heated-fluid generator device 200 has the proper structure to directly engage one or more of the supply tubes.

Still referring to FIG. 1, the heated-fluid generator device 200 may be positioned in the wellbore 160 using a locating or pack-off device such as liner hanger 400. The liner hanger 400 may include an elongated cylindrical body 410 and slips 430. When the liner hanger 400 is actuated, the slips 430 are shifted to contact and grip the inner cylindrical wall of the casing 110. The slips 430 may retain the position of the liner hanger 400, which in turn retains the heated-fluid generator device 200 in the desired position proximal to the formation 130. In certain embodiments, the liner hanger 400 further includes substantially circumferential packer seals 420. The packer seals 420, when actuated, extend radially to press against and substantially seal with the casing. The liner hanger 400 may include a polished bore receptacle 450, which can be used to locate and retain the connector 500, the heated-fluid generator device 200, or both.

Figure 2:
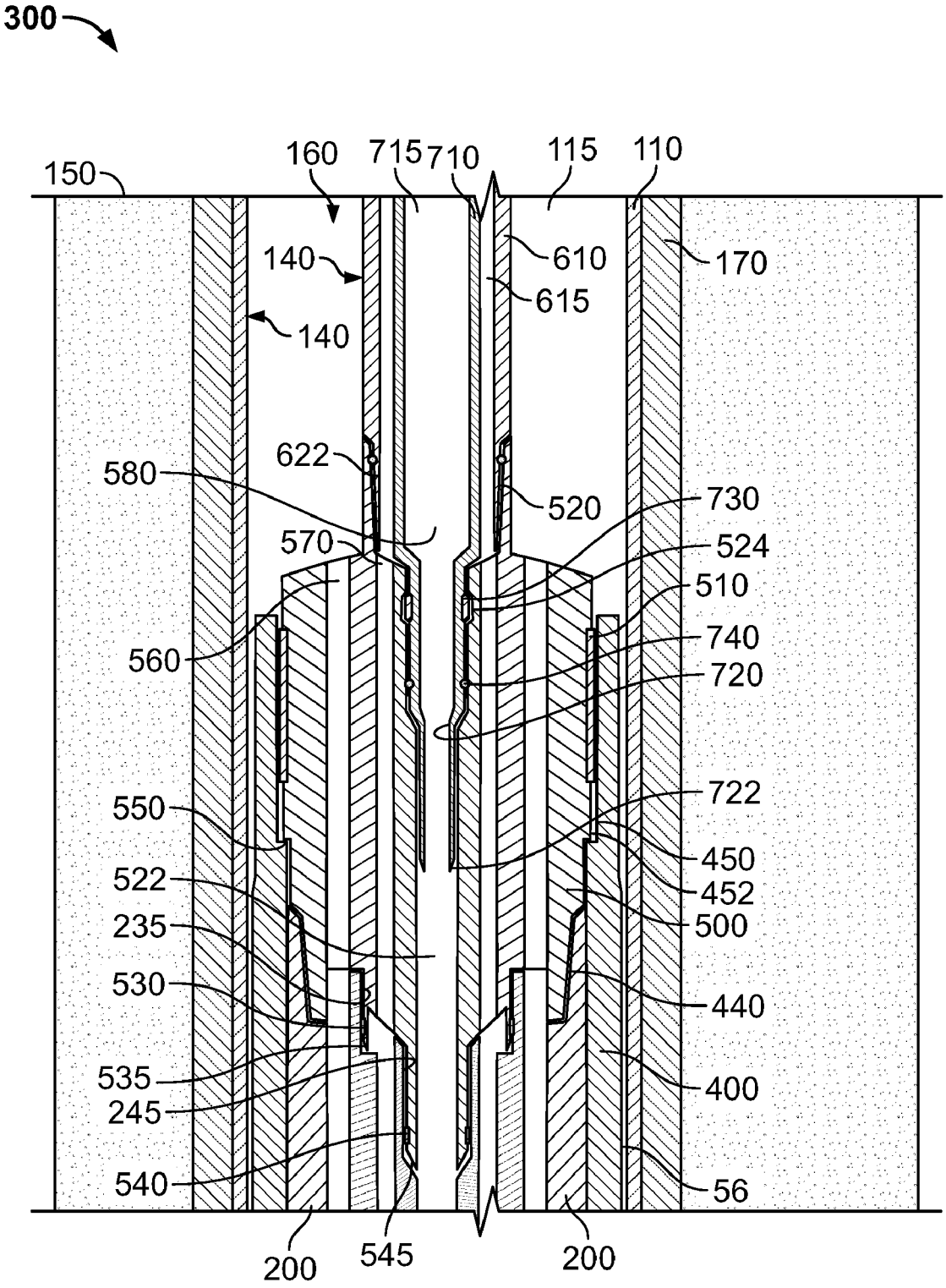
FIG. 2 is a cross-sectional view of a portion of the supply tube system of FIG. 1 taken along line 2-2.

Referring to FIG. 2, the supply tube system 140 may include one or more tubes that are in communication with the heated-fluid generator device 200. In this embodiment, the supply tube system 140 includes the casing 110, an intermediate tube 610 and an inner tube 710. Other embodiments may include fewer or more tubes or may exclude the casing 110 as part of the supply tube system 140. In certain embodiments, some or all of the tubes of supply tube system 140 can be coupled to the heated-fluid generator device 200 using a connector 500. In some embodiments, each of these tubes 110, 610, and 710 of the supply tube system 140 may be disposed nested within one another. In some embodiments, they may be substantially coaxial relative to one another. Accordingly, tubes 110, 610, and 710 may be substantially concentric. In other embodiments, a longitudinal axis of one or more of the tubes 110, 610, 710 may laterally offset from another of the tubes 110, 610, 710, but still nested.

The intermediate tube 610 and inner tube 710 of the supply tube system 140 may comprise a metallic or other material. If used in supporting the heated-fluid generator 200 as it is deployed into or out of the wellbore 160, the material may have sufficient strength to support the heated-fluid generator device 200. The intermediate tube 610 and inner tube 710 may be configured to carry a fluid, such as air, water, or natural gas. In some instances, the intermediate tube 610 and/or the inner tube 710 may comprise coiled tubing, a tubing that is provided to the well site coiled on a spool and uncoiled prior to or as it is deployed into the wellbore 160 (refer, for example, to FIG. 1 which shows a spool 145 of coiled tubing that is uncoiled as it is lowered into the wellbore 160). Suitable coiled tubing is available from Quality Tubing, Inc., of Houston, Tex., and from other coiled tubing manufacturers or suppliers. Coiled tubing is typically continuous with no readily separable connections (i.e. no threaded pin and box connections). However, it is within the scope of the invention to provide the coiled tubing with readily separable connections, such as ferrule type connections, bayonet style connections or with more permanent connections, such as welds or stab in permanent connections. Use of coiled tubing enables the tubing and any equipment attached to the tubing to quickly run into and out of the wellbore 160, because it reduces or eliminates (if continuous) time spent connecting lengths of jointed tubing.

If not coiled tubing, the intermediate tube 610 and/or inner tube 710 may comprise other types of tubulars. For example, the intermediate tube 610 and/or inner tube 710 may comprise a string of consecutive jointed tubes that are attached end-to-end. Such a string of tubes may be used, for example, in embodiments that require tube walls having a thickness or diameter that would render providing the coiled tubing as undesirable, impractical, or impossible. The intermediate tube 610 and/or inner tube 710 may comprise helically wound steel tube umbilical or electrohydraulic umbilical tubing. The umbilical tubing can be provided with metallic wire, fiber optic, and/or hydraulic control lines, for example, for conveying power or signals between the heated-fluid generator 200 and the surface. Also, the intermediate tube 610 and inner tube 710 can be different types of tubes. For example, in one instance, the larger diameter intermediate tube 610 may be jointed tubing, while the inner tube 710 is coiled or umbilical tube.

In this embodiment, the intermediate tube 610 passes through an interior of the casing 110 and the resulting annulus between the casing 110 and the intermediate tube 610 at least partially defines an outer conduit 115. When the intermediate tube 610 is secured to the connector 500, the outer conduit 115 may be in fluid communication with ports 560 of the connector 500 (described in more detail below in connection with FIG. 3). As such, a fluid may be supplied from the outer conduit 115, through the outer ports 560, and to the corresponding input of the heated-fluid generator device 200.

In this embodiment, the inner tube 710 passes through an interior of the intermediate tube 610 and the resulting annulus between the inner tube 710 and the intermediate tube 610 at least partially defines an intermediate conduit 615. The inner tube 710 defines an inner conduit 715 therein. As such, the outer conduit 115 may have an annular configuration that surrounds the intermediate conduit 615, and the intermediate conduit 615 may have an annular configuration that surrounds the inner conduit 715.

Electric or hydraulic control lines may be disposed within one of the conduits, such as the inner conduit 715, intermediate conduit 615 or the outer conduit 115. For example, the electric or hydraulic control lines may be disposed in the conduit 115, 615, or 715 that passes air or other oxygenated gas to the heated-fluid generator 200. The electric of hydraulic control lines may be capable of conveying power or signals between the heated-fluid generator 200 and other equipment on the surface 150.

One or more of the supply tubes 610, 710 may comprise centralizers that are adapted to maintain the tubes in a substantially coaxial position. The centralizers may comprise spacers that extend in a radial direction so as to maintain proper spacing between the tubes. Alternatively, one or more tubes may be self-centralizing when the tubes are coupled to the heated-fluid generator device 200 inside the wellbore (described in more detail below).

While the intermediate tube 610, inner tube 710, connector 500 and/or heated-fluid generator device 200 can be assembled to one another in any order, on the surface or in the wellbore, in some embodiments the intermediate tube 610, connector 500, and heated-fluid generator device 200 may be assembled at the surface before being lowered into the wellbore 160. The intermediate tube 610 may include threads 622 or another mechanical engagement device adapted to seal and secure the intermediate tube 610 with connector 500. When the intermediate tube 610 is secured to the connector 500, the intermediate conduit 615 may be in fluid communication with ports 570 of the connector 500. As such, fluid may be supplied from the intermediate conduit 615, through the intermediate ports 570 and to the corresponding input of the heated-fluid generator device 200.

A stinger/seal assembly 720 may be disposed at the lower end of the inner tube 710 so that the inner tube may be readily connected with the connector 500 downhole. For example, the inner tube 710 with the stinger/seal 720 assembly may be lowered into the wellbore 160 inside of the intermediate tube 610 until a stab portion 722 of the stinger/seal assembly 720 engages an inner receptacle 522 of the connector 500. In such circumstances a latch mechanism 730 of the stinger/seal assembly 720, for example outwardly biased or adjustable dogs, may join with a mating groove 524 in the receptacle 522 so as to secure the position of the inner tube 710 relative to the connector 500. In this embodiment, stinger/seal assembly 720 may include a seal 740 that substantially seals against the wall of the connector 500 to prevent fluid in the inner conduit 715 from seeping past the stinger/seal assembly 720 into the intermediate conduit 615. When the inner tube 710 is joined with the connector 500, the wall of the inner tube 710 may act as a divider, thus providing two distinct fluid paths (e.g., the inner conduit 715 and the intermediate conduit 615) inside the intermediate tube 610. The inner conduit 715 may be substantially cylindrical and in fluid communication with an inner port 580 of the connector 500. As such, fluid may be supplied from the inner conduit 715, through the inner port 580 and to the input of the heated-fluid generator device 200.

As previously described, the connector 500 joins the heated-fluid generator device 200 to the supply tube system 140. The connector 500 may have a circumferential seal 510 that substantially seals against the polished bore receptacle 450 to prevent fluid from seeping between the outer surface of the connector 500 and the receptacle 450. In some circumstances, the seal 510 may be configured to maintain the seal between the surfaces at high operating temperatures. Furthermore, the connector 500 may include threads 440 or another mechanical engagement device to couple with the heated-fluid generator device 200. As such, the connector may be coupled to the heated-fluid generator device 200 at the surface and then collectively lowered into the well as the threads 440 secure the heated-fluid generator device 200 to the connector 500.

Still referring to FIG. 2, the connector may also include other portions that mate with the heated-fluid generator device 200. In this embodiment, the connector 500 includes a circumferential seal 530 proximal to an intermediate stab portion 535. The intermediate stab portion is configured to fit within a mating sealing surface 235 of the heated-fluid generator device 200 when the previously described threads 440 are used to secure the connector 500 to the heated-fluid generator device 200. In such circumstances, the seal 530 may substantially seal against the mating sealing surface 235 to prevent seepage of fluid between the ports 560 and 570 of the connector 500 (see FIG. 3). The connector may also include a circumferential seal 540 disposed proximal to an inner stab portion 545. The inner stab portion is configured to fit within a mating receptacle 245 of the heated-fluid generator device 200 when the connector 500 is secured to the heated-fluid generator device 200. The intermediate stab portion 535 and the inner stab portion 545 may be a press fit connection or some other type of mechanical connection.

In this embodiment, the connector 500 is configured to be at least partially received in the polished bore receptacle 450 of the liner hanger 400. For example, the connector 500 may include at least one locating shoulder 550 (sometimes referred to as a no-go shoulder). The locating shoulder 550 may be configured to rest upon a mating shoulder 452 of the polished bore receptacle 450. As such, the shape of the polished bore receptacle 450 may centralize the position of the connector 500 as the device 500 is lowered into the liner hanger 400. As previously described, the circumferential seal 510 of the self centralizing connector 500 substantially seals against the polished inner wall of the polished bore receptacle 450 to prevent fluid in the outer conduit 115 from seeping past the threads 440.

Figure 3:
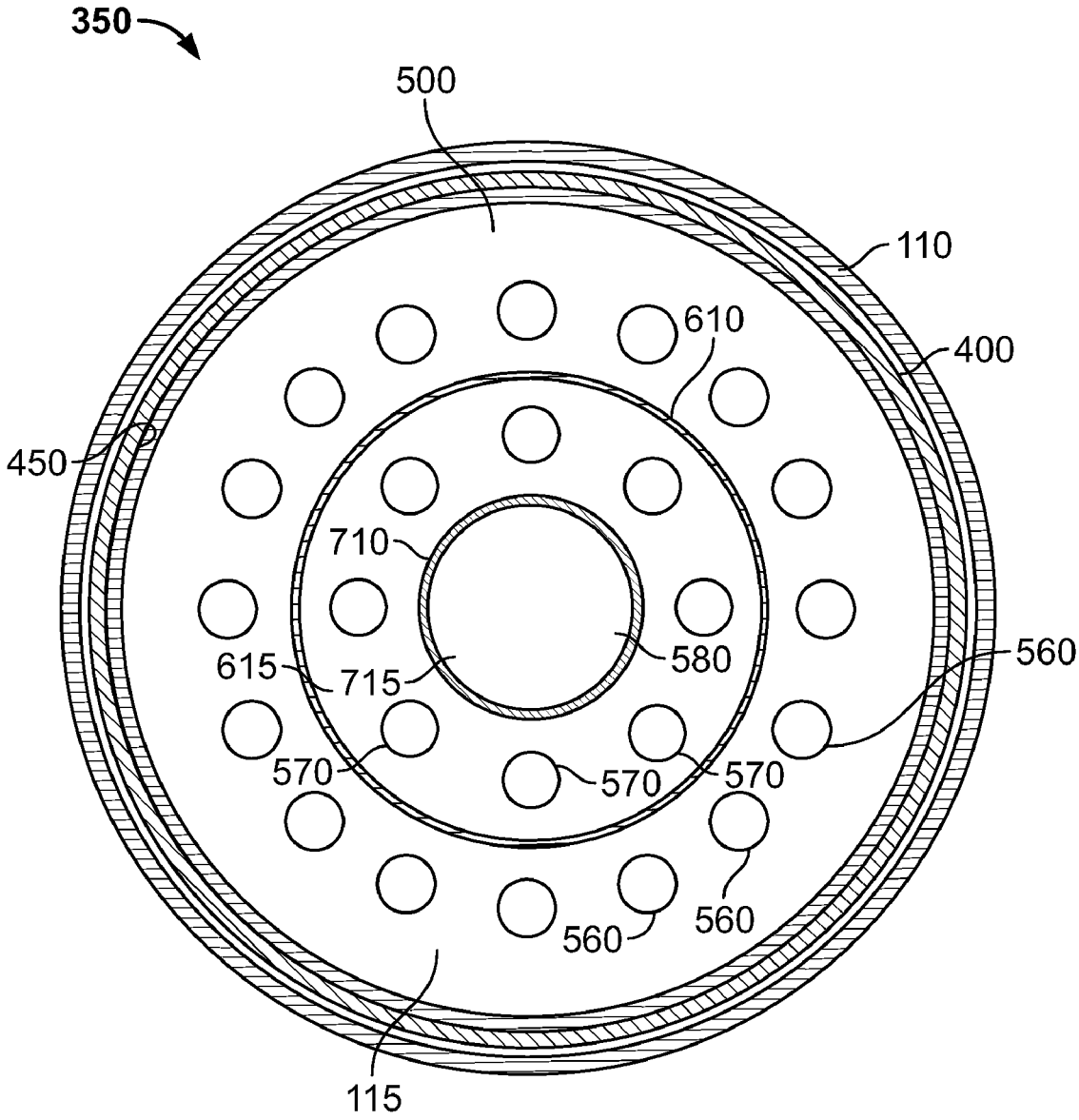
FIG. 3 is a cross-section view of the supply tube system of FIG. 1 within the wellbore taken along line 3-3.

Referring now to FIG. 3, the ports 560, 570, and 580 guide supply fluids to the appropriate inputs of the heated-fluid generator device 200. Accordingly, the ports 560, 570, 580 are positioned on the connector 500 to communicate with their respective conduits 115, 615, 715. The ports 560, 570, 580, in turn, are provided in communication with a respective port of the heated-fluid generator device 200 (see FIG. 2). Each of ports 560, 570, and 580 can be a single aperture or multiple apertures as is shown in FIG. 3. Furthermore, the ports need not be circular as is depicted in FIG. 3, but may be other shapes.

In some embodiments, the outer ports 560 may feed a fluid from the outer conduit 115 to the input of the heated-fluid generator device 200. Also, the intermediate ports 570 may feed another fluid from the intermediate conduit 615 to the input of the heated-fluid generator device 200. Furthermore, the inner port 580 may feed a third fluid from the inner conduit 715 to the input of the heated-fluid generator device 200. In one instance, the heated-fluid generator device 200 is a steam generator, the outer conduit 115 can contain water, the intermediate conduit 615 air, and the inner conduit 715 fuel (e.g. natural gas). In other instances where the heated-fluid generator device 200 is a steam generator, depending on the specifics of the application, the outer conduit 115 can contain air or fuel, the intermediate conduit 615 water or fuel, and the inner conduit 715 water or air.

Figure 4:
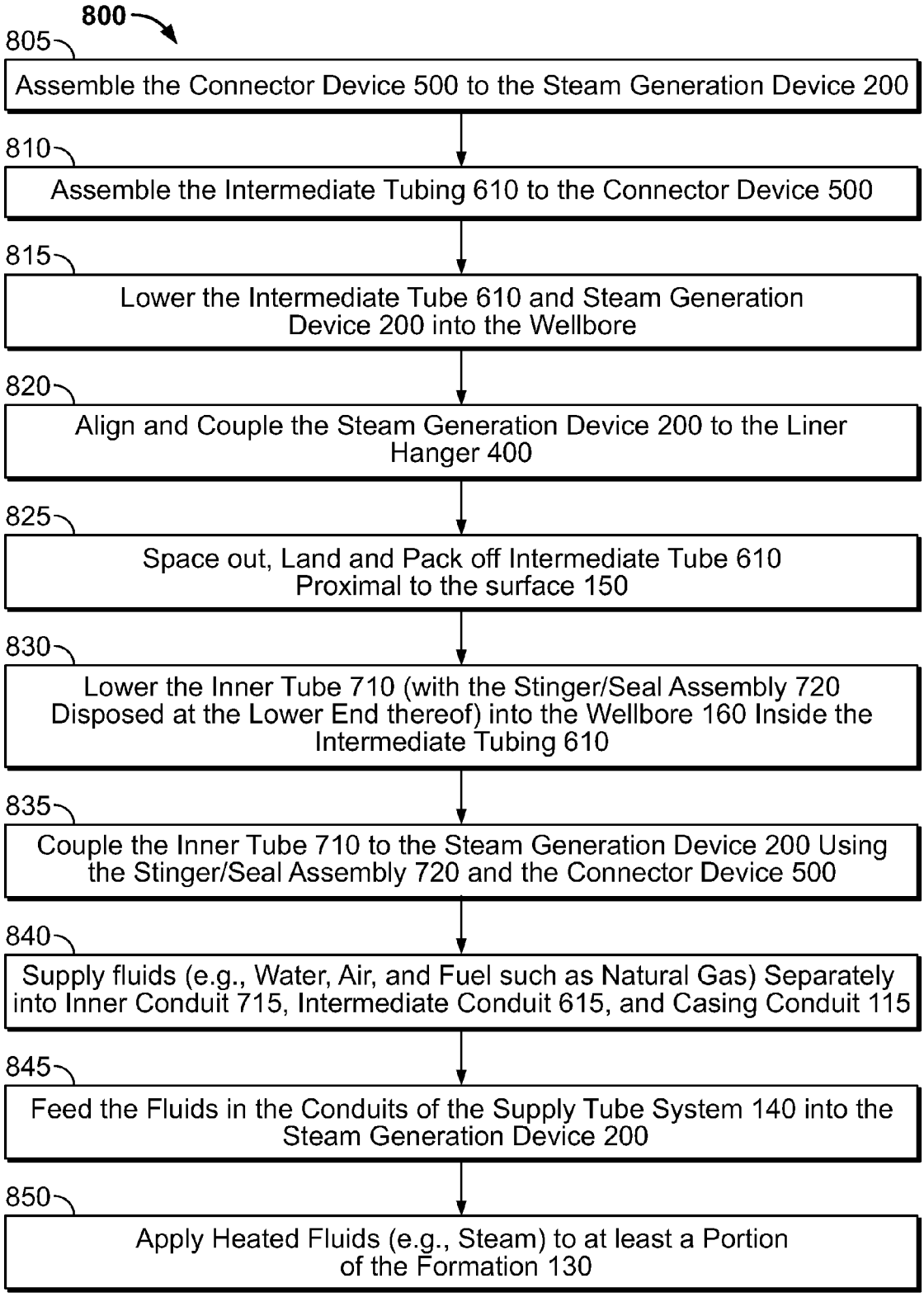
FIG. 4 a diagram showing an embodiment of a process for deploying a supply tube system and a heated-fluid generator device in a wellbore.

In operation, the supply tube system 140 and the heated-fluid generator device 200 may be deployed into the wellbore 160 separately or partially assembled. Referring to FIG. 4, one exemplary method 800 of coupling a heated-fluid generator device 200 to a supply tube system 140 may include deploying at least one tube within another tube. The method 800 may include an operation 805 of assembling the connector 500 to the heated-fluid generator device 200. For example, the connector 500 may be secured to the heated-fluid generator device 200 using the threads 440 (FIG. 2) or other previously described connections. The method 800 may also include the operation 810 of assembling the intermediate tubing 610 to the connector 500. The intermediate tubing 610 may be assembled to the connector using threads 622 or another mechanical engagement device.

After the intermediate tube 610 and the heated-fluid generator device 200 are coupled to one another via the connector 500, the method 800 may further include the operation 815 of lowering the intermediate tube 610 and the heated-fluid generator device 200 into the wellbore 160. As previously described, the intermediate tube 610 may comprise a continuous metallic tubing that is uncoiled at the surface 150 as the intermediate tube is lowered into the wellbore 160. In such instances, the continuous metallic tubing may be plastically deformed from a coiled state to an uncoiled state (e.g., generally straightened or the like) as the intermediate tube is lowered into the wellbore 160. The wall thickness and material properties of the intermediate tube 610 may provide sufficient strength to support at least a portion of the weight of the heated-fluid generator device as it is lowered into the wellbore.

When heated-fluid generator device 200 is lowered to a position proximal to the formation 130, the method may include the operation 820 of aligning and coupling the heated-fluid generator device 200 to the liner hanger 400. For example, the heated-fluid generator device 200 may be aligned with and couple to the liner hanger 400 when the shoulder 550 of the connector 500 engages the polished bore receptacle 450 in the liner hanger 400. In some circumstances, the method 800 may also include the operation 825 of spacing out, landing, and packing off the intermediate tube 610 proximal to the ground surface 150. Such an operation may facilitate the deployment of the inner tube 710 from the ground surface 150 and through the intermediate tube 610.

The method 800 may further include the operation 830 of lowering the inner tube 710 into the wellbore 160 inside the intermediate tubing 610. As previously described, the inner tube 710 may comprise continuous metallic tubing having a smaller diameter than that of the intermediate tube 610 (refer, for example, to FIG. 1 which shows the spool 145 of continuous tubing that is uncoiled as it is lowered into the wellbore 160). In some embodiments, the inner tube 710 may include the stinger/seal assembly 720 disposed at the lower end thereof so that the inner tube 710 can join with the connector 500 located downhole.

When the inner tube 710 reaches the appropriate depth, the method 800 may include the operation 835 of coupling the inner tube 710 to the heated-fluid generator device 200. In some embodiments, the inner tube 710 may be coupled to the heated-fluid generator device 200 when the stinger/seal assembly 720 engages the connector 500 and the latch mechanism 730 engages the mating groove 524. As such, the wall of the inner tube 710 may separate the inner conduit 715 from the intermediate conduit 615.

The method 800 may also be used to supply fluids to the downhole heated-fluid generator device 200. As shown in operation 840, fluids (e.g., water, air, and fuel such as natural gas) may be supplied separately into an associated conduit 115, 615, and 715. For example, natural gas may be supplied through the inner conduit 715, air or oxygen gas may be supplied through the intermediate conduit 615, and water may be supplied through the casing conduit 115. The method 800 may also include the operation 845 of feeding the fluids (e.g., water, air, and fuel such as natural gas) inside the conduits 715, 615, 115 of the supply tube system 140 into the heated-fluid generator device 200. For example, the air and natural gas may be used in a combustion process or a catalytic process, which heats the water into steam. The method 800 may also include the operation 850 of applying the heated fluids (e.g., steam) to at least a portion of the formation 130. As previously described, the heated-fluid generator device 200 may be disposed in the wellbore so that the exhaust port 210 is proximal to the formation 130. When the water is converted into steam by the downhole heated-fluid generator device 200, the steam may be applied to the formation 130 as it is output from the port 210.

It should be understood that the supply tube system 140 and the heated-fluid generator device 200 may be coupled and lowered into the wellbore 160 using methods other than those described in FIG. 4. In one example, the inner tube 710 and the intermediate tube 610 may be coupled with the heated-fluid generator device 200 using the connector 500 above the ground surface. Then the inner tube 710, the intermediate tube 610, connector 500, and heated-fluid generator device 200 may be simultaneously lowered into the wellbore 160 until the connector 500 engages the polished bore receptacle 450 in the liner hanger 400. In another example, the inner tube 710 and the intermediate tube 610 may not be coupled with the heated-fluid generator device 200 using the connector 500 above the ground surface. Instead, the heated-fluid generator device 200 and the connector 500 may be disposed downhole within the liner hanger 400 before the tubes 610 and 710 are lowered thereto. The intermediate tube 610 and the inner tube 710 may use threaded connections or stab connections to engage the connector 500. In yet another example, the intermediate tube 610 may be coupled with the connector 500 above the ground surface and then lowered into the well to engage the heated-fluid generator device 200 located in the wellbore 160. In such circumstances, the inner tube 710 may be lowered into the wellbore 160 inside the intermediate tube 610 until the stinger/seal assembly 720 attached to the end of the inner tube 710 engages the connector 500.

A number of embodiments of the invention have been described. Nevertheless, it will be understood that various modifications may be made without departing from the spirit and scope of the invention. Accordingly, other embodiments are within the scope of the following claims.

What is claimed is:

1. A method, comprising:

lowering a heated-fluid generator device into a wellbore while the heated-fluid generator device is coupled to a first tube, wherein the heated-fluid generator device comprises a steam generator to output steam to a region proximal to the wellbore; and coupling a second tube to the heated-fluid generator, at least one of the first tube and the second tube comprising a coiled tubing uncoiled from a spool and inserted into the wellbore, wherein at least one of the first tube and the second tube at least partially defines an annular conduit to deliver water to a water input port of the steam generator.

2. The method of claim 1, wherein the first tube supports at least a portion of a weight of the heated-fluid generator device while lowering the heated-fluid generator device into the wellbore.

3. The method of claim 1, wherein one of the first and second tubes is disposed inside of the other tube to define a first fluid conduit inside of a second fluid conduit.

4. The method of claim 1, further comprising coupling the first tube to the heated-fluid generator device using a connector, wherein one of the connector and the second tube comprises a stab portion and the other comprises a receptacle adapted to sealingly receive the stab portion and couple second tube with the connector after the heated-fluid generator device is lowered into the wellbore.

5. The method of claim 4, wherein the connector comprises a first port in communication with the first fluid conduit and the heated-fluid generator device and comprises a second port in communication with the second conduit and the heated-fluid generator device.

6. The method claim 1, wherein the first tube and the second tube are received within a casing and the casing, the first tube, and the second tube at least partially define at least three substantially nested conduits.

7. The method of claim 6, further comprising receiving a fuel through the first conduit to the heated-fluid generator device, receiving an oxygen-containing fluid through the second conduit to the heated-fluid generator device, and receiving water through a third conduit.

8. The method of claim 1, further comprising delivering water, an oxygen-containing fluid, and a fuel at the heated-fluid generator device so as to apply a heated fluid to a hydrocarbon formation disposed proximal to the wellbore.

9. The method of claim 1, wherein at least one of the first tube and the second tube is continuous between the heated-fluid generator and a ground surface.

10. A method, comprising:

lowering a heated-fluid generator device into a wellbore while the heated-fluid generator device is coupled to a first tube, the first tube being uncoiled from a spool as the heated-fluid generator device is lowered into the wellbore, wherein the heated-fluid generator device comprises a steam generator to output steam to a region proximal to the wellbore;

securing the heated-fluid generator device in a polished bore receptacle so as to form a seal therebetween, wherein an output port of the steam generator is arranged below the seal; and coupling a second tube to the heated-fluid generator, one of the first and second tubes nested within the other to define at least a portion of at least two fluid conduits.

11. The method of claim 10, wherein the first tube supports at least a portion of a weight of the heated-fluid generator device while it is being lowered into the wellbore.

12. The method of claim 10, wherein the first tube and the second tube define at least a portion of at least three fluid conduits.

13. The method of claim 10, wherein the first tube is substantially continuous between the heated-fluid generator device and a ground surface.

14. The method of claim 10, wherein lowering the heated-fluid generator device into a wellbore further comprises receiving the heated-fluid generator device at a liner hanger having the polished bore receptacle.

15. A system for generating heated fluid in a wellbore, comprising:

a heated-fluid generator device disposed in a wellbore and adapted to output a heated fluid, wherein the heated-fluid generator device comprises a steam generator; and a first and second tubes residing in the wellbore and coupled to the heated-fluid generator, the first tube at least partially defining a first conduit and the second tube at least partially defining a second conduit, both the first and second conduits being in fluid communication with the heated-fluid generator device, wherein at least one of the first and second tubes comprises a coiled tubing that is uncoiled from a spool when arranged in the wellbore; and a wellbore casing disposed in the wellbore, the wellbore casing surrounding at least a portion of the second tube to define a third conduit between the casing and the second tube, the third conduit adapted to communicate a fluid into an input of the heated-fluid generator device.

16. The system of claim 15, wherein the first tube resides within the second tube so as to define a inner fluid conduit disposed within an intermediate fluid conduit.

17. The system of claim 15, wherein at least one of the first and second tubes is substantially continuous between the heated-fluid generator and a ground surface.

18. The system of claim 15, further comprising:

a hanger device adapted to grip a wall of the wellbore and adapted to receive and support the heated-fluid generator device in the wellbore; and a connector adapted to couple at least one of the first and second tubes to the heated-fluid generator device and adapted to substantially seal against the hanger device.

19. A method, comprising:

lowering a heated-fluid generator device into a wellbore while the heated-fluid generator device is coupled to a first tube; and coupling a second tube to the heated-fluid generator, at least one of the first tube and the second tube comprising a coiled tubing uncoiled from a spool and inserted into the wellbore, wherein the first tube is coupled to the heated-fluid generator device using a connector, and one of the connector and the second tube comprises a stab portion and the other comprises a receptacle adapted to sealingly receive the stab portion and couple second tube with the connector after the heated-fluid generator device is lowered into the wellbore.

20. The method of claim 19, wherein the first tube supports at least a portion of a weight of the heated-fluid generator device while lowering the heated-fluid generator device into the wellbore.

21. The method of claim 19, wherein one of the first and second tubes is disposed inside of the other tube to define a first fluid conduit inside of a second fluid conduit.

22. The method of claim 19, wherein the connector comprises a first port in communication with the first fluid conduit and the heated-fluid generator device and comprises a second port in communication with the second conduit and the heated-fluid generator device.

23. The method claim 19, wherein the first tube and the second tube are received within a casing and the casing, the first tube, and the second tube at least partially define at least three substantially nested conduits.

24. The method of claim 23, further comprising receiving a fuel through the first conduit to the heated-fluid generator device, receiving an oxygen-containing fluid through the second conduit to the heated-fluid generator device, and receiving water through a third conduit.

25. The method of claim 19, wherein the heated-fluid generator device comprises a steam generator, the method further comprising delivering water, an oxygen-containing fluid, and a fuel to the heated-fluid generator device so as to apply a heated fluid to a hydrocarbon formation disposed proximal to the wellbore.

26. The method of claim 19, wherein at least one of the first tube and the second tube is continuous between the heated-fluid generator and a ground surface.

27. The method of claim 19, wherein lowering the heated-fluid generator device into a wellbore further comprises receiving the heated-fluid generator device at a liner hanger.

28. The method of claim 27, wherein receiving the heated-fluid generator device at the liner hanger further comprises sealingly coupling the heated-fluid generator device to a polished bore receptacle of the liner hanger.

29. A method, comprising:

lowering a heated-fluid generator device into a wellbore while the heated-fluid generator device is coupled to a first tube, wherein lowering the heated-fluid generator device into a wellbore further comprises receiving the heated-fluid generator device at a liner hanger; and coupling a second tube to the heated-fluid generator, at least one of the first tube and the second tube comprising a coiled tubing uncoiled from a spool and inserted into the wellbore.

30. The method of claim 29, wherein the first tube supports at least a portion of a weight of the heated-fluid generator device while lowering the heated-fluid generator device into the wellbore.

31. The method of claim 29, wherein one of the first and second tubes is disposed inside of the other tube to define a first fluid conduit inside of a second fluid conduit.

32. The method of claim 29, further comprising coupling the first tube to the heated-fluid generator device using a connector, wherein one of the connector and the second tube comprises a stab portion and the other comprises a receptacle adapted to sealingly receive the stab portion and couple second tube with the connector after the heated-fluid generator device is lowered into the wellbore.

33. The method of claim 32, wherein the connector comprises a first port in communication with the first fluid conduit and the heated-fluid generator device and comprises a second port in communication with the second conduit and the heated-fluid generator device.

34. The method claim 29, wherein the first tube and the second tube are received within a casing and the casing, the first tube, and the second tube at least partially define at least three substantially nested conduits.

35. The method of claim 34, further comprising receiving a fuel through the first conduit to the heated-fluid generator device, receiving an oxygen-containing fluid through the second conduit to the heated-fluid generator device, and receiving water through a third conduit.

36. The method of claim 29, wherein the heated-fluid generator device comprises a steam generator, the method further comprising delivering water, an oxygen-containing fluid, and a fuel to the heated-fluid generator device so as to apply a heated fluid to a hydrocarbon formation disposed proximal to the wellbore.

37. The method of claim 29, wherein at least one of the first tube and the second tube is continuous between the heated-fluid generator and a ground surface.

38. The method of claim 29, wherein receiving the heated-fluid generator device at the liner hanger further comprises sealingly coupling the heated-fluid generator device to a polished bore receptacle of the liner hanger.

39. A method, comprising:

lowering a heated-fluid generator device into a wellbore while the heated-fluid generator device is coupled to a first tube, the first tube being uncoiled from a spool as the heated-fluid generator device is lowered into the wellbore, wherein lowering the heated-fluid generator device into a wellbore further comprises receiving the heated-fluid generator device at a liner hanger; and coupling a second tube to the heated-fluid generator, one of the first and second tubes nested within the other to define at least a portion of at least two fluid conduits.

40. The method of claim 39, wherein the first tube supports at least a portion of a weight of the heated-fluid generator device while it is being lowered into the wellbore.

41. The method of claim 39, wherein the first tube and the second tube define at least a portion of at least three fluid conduits.

42. The method of claim 39, wherein the first tube is substantially continuous between the heated-fluid generator device and a ground surface.

43. The method of claim 39, wherein receiving the heated-fluid generator device at the liner hanger further comprises sealingly coupling the heated-fluid generator device to a polished bore receptacle of the liner hanger.

44. A system for generating heated fluid in a wellbore, comprising:

a heated-fluid generator device disposed in a wellbore and adapted to output a heated fluid;

a first and second tubes residing in the wellbore and coupled to the heated-fluid generator, the first tube at least partially defining a first conduit and the second tube at least partially defining a second conduit, both the first and second conduits being in fluid communication with the heated-fluid generator device, wherein at least one of the first and second tubes comprises a coiled tubing that is uncoiled from a spool when arranged in the wellbore;

a hanger device adapted to grip a wall of the wellbore and adapted to receive and support the heated-fluid generator device in the wellbore; and a connector adapted to couple at least one of the first and second tubes to the heated-fluid generator device and adapted to substantially seal against the hanger device.

45. The system of claim 44, wherein the first tube resides within the second tube so as to define a inner fluid conduit disposed within an intermediate fluid conduit.

46. The system of claim 45, further comprising a wellbore casing disposed in the wellbore, the wellbore casing surrounding at least a portion of the second tube to define a fluid conduit between the casing and the second tube.

47. The system of claim 44, wherein at least one of the first and second tubes is substantially continuous between the heated-fluid generator and a ground surface.

48. The system of claim 44, wherein the heated-fluid generator device comprises a steam generator.

* * * * *

UNITED STATES PATENT AND TRADEMARK OFFICE

CERTIFICATE OF CORRECTION

PATENT NO. : 7,640,987 B2
APPLICATION NO. : 11/205871
DATED : January 5, 2010
INVENTOR(S) : Kalman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 521 days.

Signed and Sealed this

Sixteenth Day of November, 2010

David J. Kappos

David J. Kappos
*Director of the United States Patent and Trademark Office*